US007714509B2

(12) United States Patent
Woo et al.

(10) Patent No.: US 7,714,509 B2
(45) Date of Patent: May 11, 2010

(54) PLASMA DISPLAY PANEL HAVING AUXILIARY TERMINALS

(75) Inventors: Seok-Gyun Woo, Suwon-si (KR); Kyoung-Doo Kang, Suwon-si (KR); Won-Ju Yi, Suwon-si (KR)

(73) Assignee: Samsung SDI Co., Ltd., Yeongtong-gu, Suwon-si, Gyeonggi-do (KR)

( * ) Notice: Subject to any disclaimer, the term of this patent is extended or adjusted under 35 U.S.C. 154(b) by 708 days.

(21) Appl. No.: 11/498,902

(22) Filed: Aug. 4, 2006

(65) Prior Publication Data

US 2007/0035247 A1 Feb. 15, 2007

(30) Foreign Application Priority Data

Aug. 12, 2005 (KR) ..... 10-2005-0074501

(51) Int. Cl.
*H01J 17/49* (2006.01)

(52) U.S. Cl. ..... 313/583; 313/584

(58) Field of Classification Search ..... 313/583–584
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,744,909 A * 4/1998 Amano ..... 313/585
5,786,794 A 7/1998 Kishi et al.

(Continued)

FOREIGN PATENT DOCUMENTS

CN 2004-10049042 5/2005

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Nimeshkumar D. Patel
*Assistant Examiner*—Peter R Haderlein
(74) *Attorney, Agent, or Firm*—Robert E. Bushnell, Esq.

(57) ABSTRACT

A Plasma Display Panel (PDP) in which terminals of discharge electrodes are stably formed includes: first and second substrates spaced apart from each other and facing each other; first barrier ribs interposed between the first and second substrates and partitioning a plurality of discharge cells; and a plurality of pairs of discharge electrodes adapted to generate a discharge in the discharge cells. The discharge electrodes are buried in the first barrier ribs, extend along an outside of the discharge cells and are arranged in a direction to form a terminal in an edge of the discharge electrodes, and at least one groove is formed in an outermost side of the first barrier ribs through which the terminals of the discharge electrodes are exposed.

14 Claims, 7 Drawing Sheets

U.S. PATENT DOCUMENTS

| | | | | |
|---|---|---|---|---|
| 5,952,782 | A | 9/1999 | Nanto | |
| RE37,444 | E | 11/2001 | Kanazawa | |
| 6,583,556 | B2 * | 6/2003 | Oishi et al. | 313/495 |
| 6,630,916 | B1 | 10/2003 | Shinoda | |
| 6,707,436 | B2 | 3/2004 | Setoguchi et al. | |
| 7,420,329 | B2 * | 9/2008 | Kang | 313/583 |
| 2002/0041155 | A1 * | 4/2002 | Asami et al. | 313/583 |
| 2005/0236986 | A1 * | 10/2005 | Kwon et al. | 313/582 |
| 2006/0202626 | A1 * | 9/2006 | Woo | 313/631 |
| 2006/0223407 | A1 * | 10/2006 | Kang et al. | 445/24 |

FOREIGN PATENT DOCUMENTS

| | | |
|---|---|---|
| JP | 05-225912 | 9/1993 |
| JP | 10-172442 | 6/1998 |
| JP | 2845183 | 10/1998 |
| JP | 2917279 | 4/1999 |
| JP | 2001-043804 | 2/2001 |
| JP | 2001-325888 | 11/2001 |
| KR | 10/2005-0040635 | 5/2005 |

OTHER PUBLICATIONS

Chinese Office action issued on Jun. 26, 2009 in Applicant's corresponding Chinese Patent Application No. 2006-10110970.

* cited by examiner

PLASMA DISPLAY PANEL HAVING AUXILIARY TERMINALS

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 12 Aug. 2005 and there duly assigned Serial No. 10-2005-0074501.

BACKGROUND OF THE INVENTION

1. Field of the Invention

The present invention relates to a Plasma Display Panel (PDP).

2. Description of the Related Art

Plasma Display Panels (PDPs) have replaced conventional Cathode Ray Tubes (CRTs) and display desired images using visible light rays generated by sealing a discharge gas and supplying a discharge voltage between two substrates on which a plurality of electrodes are formed to generate vacuum ultraviolet rays and exciting phosphors on which the vacuum ultraviolet rays are directed in a predetermined pattern.

A conventional three-electrode surface discharge PDP, similar to a PDP discussed in Japanese Laid-Open Patent Publication No. 1998-172442, includes a first substrate, pairs of sustain electrodes, a first dielectric layer on the sustain electrodes, a protective layer on the first dielectric layer, a second substrate facing the first substrate, address electrodes arranged in parallel on the second substrate, a second dielectric layer on the address electrodes, barrier ribs formed on the second dielectric layer, and phosphor layers formed on a top surface of the second dielectric layer and sides of the barrier ribs.

However, the PDP has low luminous efficiency since a substantial portion (approximately 40%) of the visible light generated by the phosphor layers is absorbed by the sustain electrodes, the first dielectric layer, and the protective layers. Also, the three-electrode surface discharge PDP displays an image for a long time, causing ion-sputtering which damages the phosphor layers due to charged particles, causing a permanent afterimage.

To solve this problem, Korean Laid-Open Patent Publication No. 2005-40635 discusses a PDP that increases brightness and liminous efficiency by generating a discharge from discharge electrodes arranged on the sides of barrier ribs.

However, in this PDP in which the discharge electrodes are arranged in the sides of barrier ribs, terminals of the discharge electrodes connected to an external signal connector are exposed to the surface of the barrier ribs, which damages the terminals when the terminals are connected to the signal connector.

In more detail, a terminal of a discharge electrode is exposed to the surface of barrier ribs without any support to form a cantilever beam. Since the terminal of the discharge electrode is generally formed using a printing process, it is not strong, and drops due to an external force, and the terminal in the form of the cantilever beam is easily damaged. Also, since a shear force and a bending moment are indispensably applied to the terminal of the discharge electrode when the terminal is connected to the signal connector, the terminal of the discharge electrode can be easily damaged when it is connected to the signal connector, which increases a failure rate and increases costs.

SUMMARY OF THE INVENTION

The present invention provides a Plasma Display Panel (PDP) in which a terminal of a discharge electrode is stably arranged.

According to an aspect of the present invention, a Plasma Display Panel (PDP) is provided including: first and second substrates spaced apart from each other and facing each other; first barrier ribs interposed between the first and second substrates and partitioning a plurality of discharge cells; and a plurality of pairs of discharge electrodes adapted to generate a discharge in the discharge cells. The discharge electrodes are buried in the first barrier ribs, extend along an outside of the discharge cells arranged in a direction to form a terminal in an edge of the discharge electrodes, and at least one groove is arranged in an outermost side of the first barrier ribs through which the terminals of the discharge electrodes are exposed.

The at least one groove is preferably exposed to either a bottom or top surface of the terminals of the discharge electrodes.

The discharge electrodes are preferably spaced apart from and parallel to the terminals and further include auxiliary terminals electrically connected to the terminals.

The terminals and the auxiliary terminals are preferably spaced apart from each other on either the first substrate or the second substrate in a perpendicular direction, and the at least one groove is preferably arranged between the terminals and the auxiliary terminals.

The PDP preferably further includes a signal connector interposed between the terminal and the auxiliary terminal and adapted to be connected to both the terminal and the auxiliary terminal and to transfer an electrical signal to the discharge electrode. The signal connector preferably includes an insertion terminal adapted to be inserted between the terminal and the auxiliary terminal, and a fixing portion including a first end connected to the insertion terminal and a second end contacting either the top or the bottom of the first barrier ribs to increase a connection between the insertion terminal and the discharge electrode.

The first barrier ribs preferably include a dielectric material.

Each of the pairs of discharge electrodes preferably includes a first discharge electrode and a second discharge electrode that extend in parallel each other. The first and second discharge electrodes preferably at least partially surround the discharge cells and are arranged in a direction. The first and second discharge electrodes preferably face each other.

The PDP preferably further includes address electrodes extending to cross the first and second discharge electrodes. Terminals of the address electrodes are preferably arranged on the first substrate or the second substrate.

The PDP preferably further includes a dielectric layer covering the address electrodes.

The PDP preferably further includes second barrier ribs interposed between the dielectric layer and the first barrier ribs and adapted to partition the discharge cells together with the first barrier ribs.

The PDP preferably further includes phosphor layers arranged on sides of the second barrier ribs.

The PDP preferably further includes protective layers arranged on sides of the first barrier ribs.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
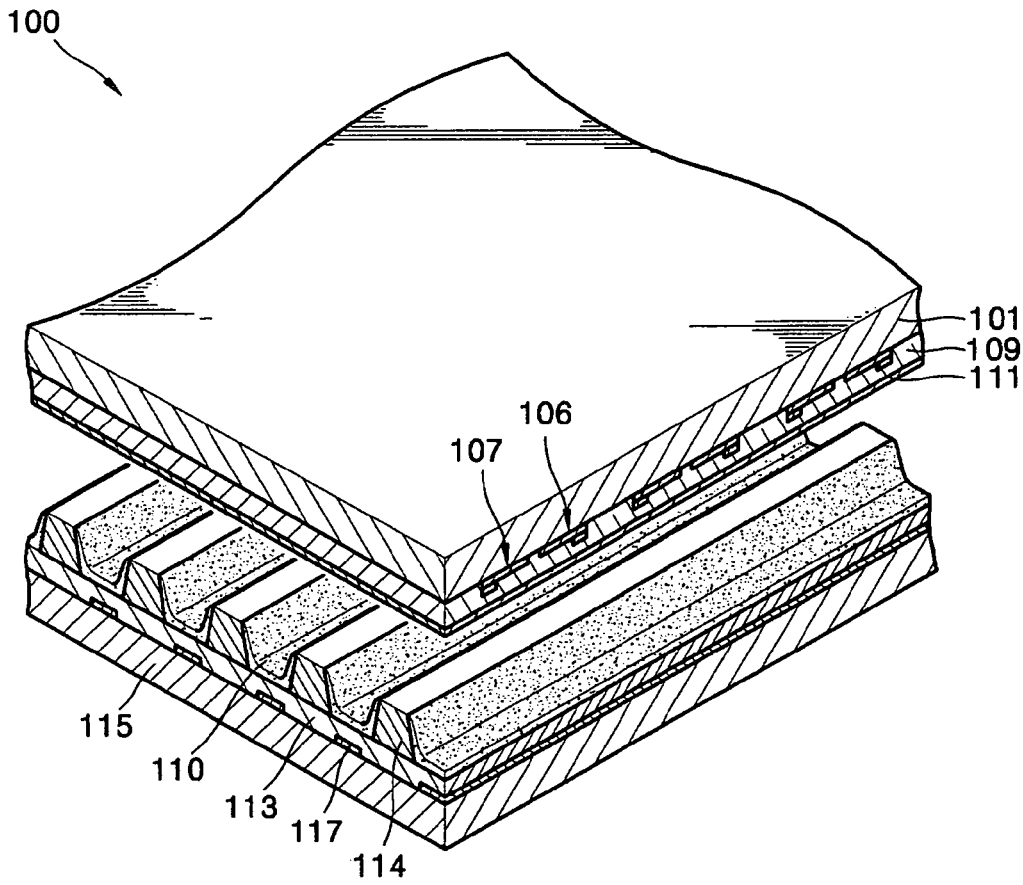
FIG. 1 (PRIOR ART)
FIG. 1 is an exploded perspective view of a conventional Plasma Display Panel (PDP)

FIG. 1 is an exploded perspective view of a conventional three-electrode surface discharge PDP 100 similar to a Plasma Display Panel (PDP) discussed in Japanese Laid-Open Patent Publication No. 1998-172442. The PDP includes a first substrate 101, pairs of sustain electrodes 106 and 107, a first dielectric layer 109 on the sustain electrodes 106 and 107, a protective layer 111 on the first dielectric layer 109, a second substrate 115 facing the first substrate 101, address electrodes 117 arranged in parallel on the second substrate 115, a second dielectric layer 113 on the address electrodes 117, barrier ribs 114 formed on the second dielectric layer 113, and phosphor layers 110 formed on a top surface of the second dielectric layer 113 and sides of the barrier ribs 114.

However, the PDP 100 has low luminous efficiency since a substantial portion (approximately 40%) of the visible light generated by the phosphor layers 110 is absorbed by the sustain electrodes 106 and 107, the first dielectric layer 109, and the protective layers 111. Also, the three-electrode surface discharge PDP 100 displays an image for a long time, causing ion-sputtering which damages the phosphor layers 110 due to charged particles, causing a permanent afterimage.

The present invention is described below more fully with reference to the accompanying drawings, in which exemplary embodiments of the present invention are shown.

A PDP 200 according to an embodiment of the present invention is described below with reference to FIGS. 2 through 6.

The PDP 200 includes a first substrate 210, a second substrate 220, first discharge electrodes 260, second discharge electrodes 270, address electrodes 250, first barrier ribs 214, second barrier ribs 224, protective layers 215, phosphor layers 225, a dielectric layer 227, a sealing member 299, first, second, and third signal connector 291, 293, and 295, and a discharge gas (not shown).

The first substrate 210 is formed of a highly transparent material such as glass. The first substrate 210 can be colored in order to increase a bright room contrast by reducing reflections. The second substrate 220 is spaced apart from the first substrate 210 and is also formed of a highly transparent material such as glass. The second substrate 220 can be colored similar to the first substrate 210.

In the current embodiment of the present invention, visible light generated in the discharge cells 230 is projected through the first substrate 210 and/or the second substrate 220. The sustain electrodes 106 and 107, the first dielectric layer 109, and the protective layer 111 formed on the first substrate 101 of the PDP 100 of FIG. 1 are not formed on the first substrate 210 and/or the second substrate 220 of the PDP 200 of FIG. 2, and thus a transmission rate of the visible light is remarkably increased. Therefore, when the PDP 200 displays an image having the brightness of a conventional PDP, the first and second discharge electrodes 260 and 270 can operate with a relatively low voltage.

The first barrier ribs 214 partition a plurality of discharge cells 230 and dummy cells 235 and are interposed between the first substrate 210 and the second substrate 220. The dummy cells 235 surround the discharge cells 230 and do not display an image. However, while the present invention is not necessarily restricted thereto, the first barrier ribs 214 partitions only the discharge cells 230. In the current embodiment of the present invention but not necessarily restricted thereto, the first barrier ribs 214, partition the discharge cells 230, which have circular cross-sections. That is, the first barrier ribs 214 can have a variety of patterns to partition the plurality of discharge cells 230. For example, like the current embodiment of the present invention, the discharge cells 230 can have many-cornered cross-sections such as triangles, tetragons, octagons, etc. or oval cross-sections.

The first barrier ribs 214 can be formed of a dielectric layer capable of accumulating wall charges by inducing charges, while preventing an electrical short of the first and second discharge cells 260 and 270 and preventing damage due to collisions between positive ions or electrons and the first and second discharge electrodes 260 and 270.

Figure 2:
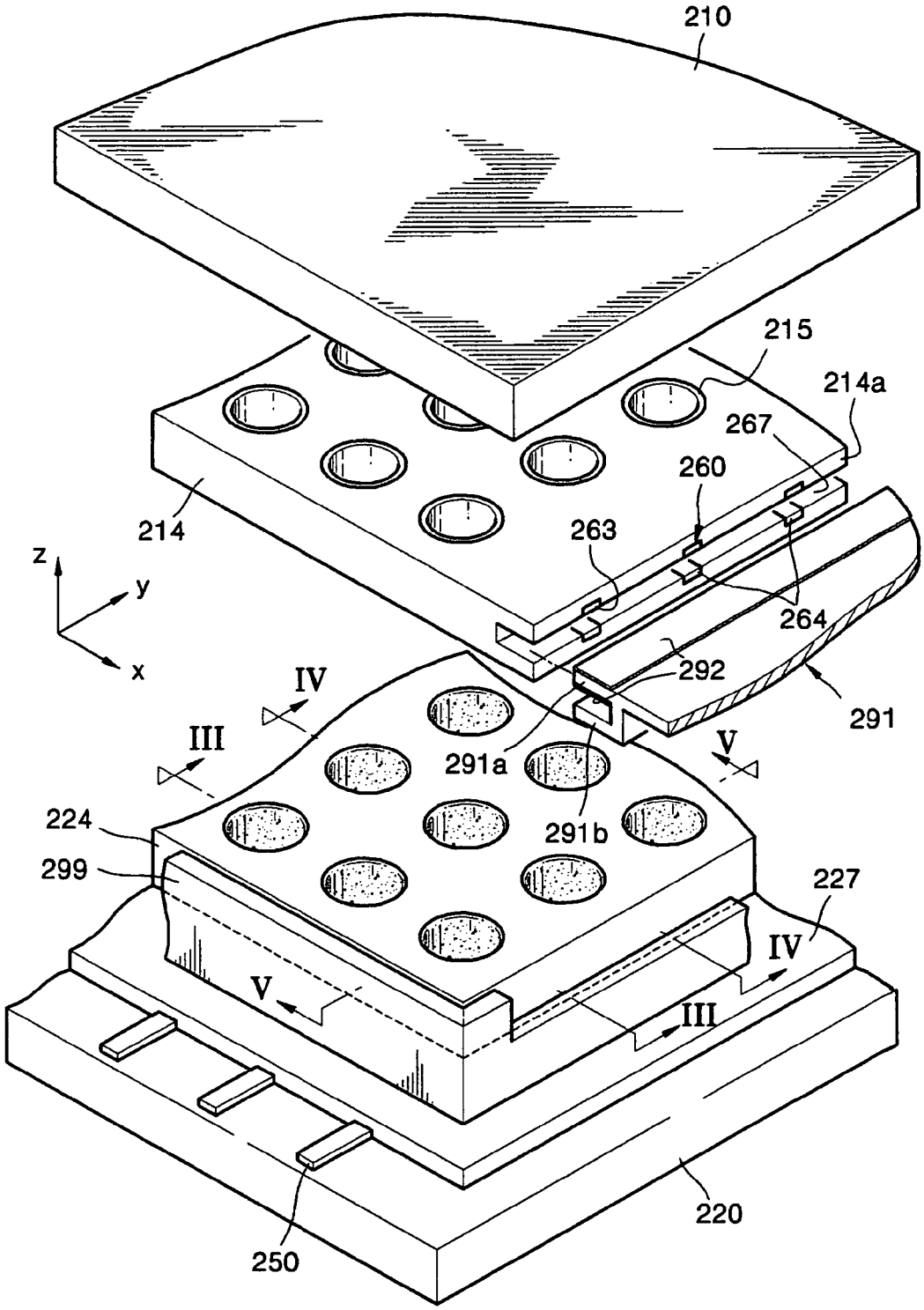
FIG. 2 is a partially exploded perspective view of a PDP according to an embodiment of the present invention.

The second barrier ribs 224 are interposed between the first barrier ribs 214 and the second substrate 220. The second barrier ribs 224 partition the discharge cells 230 like the first barrier ribs 214. Referring to FIG. 2, the second barrier ribs 224 and the first barrier ribs 214 partition the discharge cells 230 and the dummy cells 235, which have circular cross-sections, and can have a variety of patterns to form a plurality of discharge spaces. The present invention is not restricted to these shapes. Also, the first and second barrier ribs 214 and 224 can be different from each other. However, they can have the same shape in view of a constant discharge and ease of manufacturing.

Figure 3:
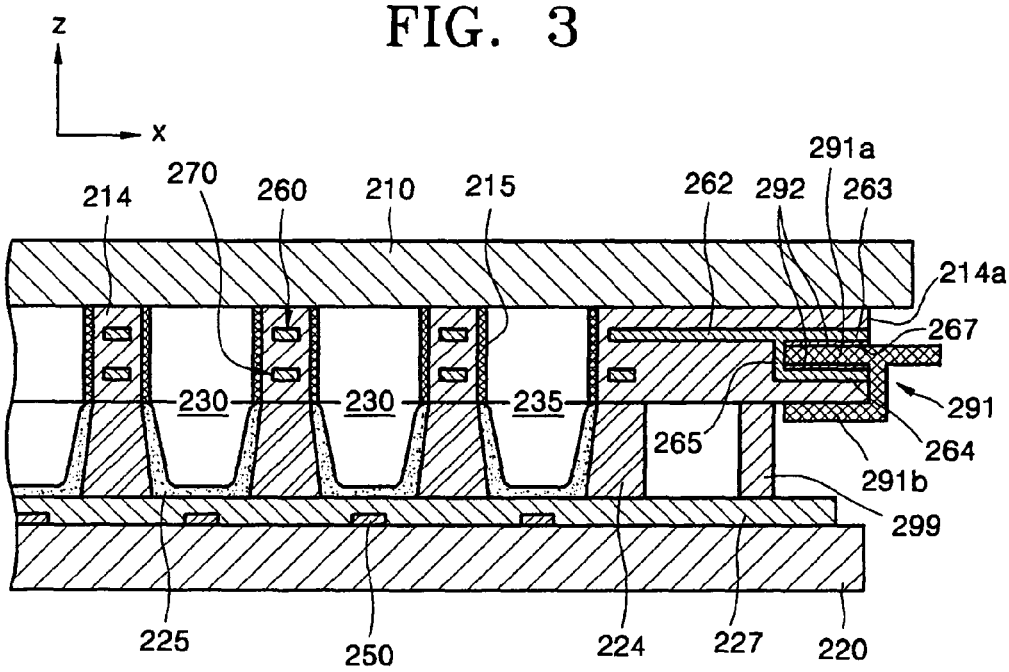
FIG. 3 is a cross-sectional view of the PDP taken along a line III-III in FIG. 2.

Referring to FIGS. 2 and 3, the first discharge electrode 260 that is paired with the second discharge electrode 270 generates a discharge from the discharge cells 230. The first discharge electrode 260 includes a first discharging portion 261, a first connecting portion 262, a first auxiliary connecting portion 265, a first terminal 263, and a first auxiliary terminal 264. The first discharging portion 261 is formed by connecting a plurality of circular first loops 261*a* in which each of the plurality of first loops 261*a* surrounds the discharge cells 230 arranged in a row. However, the first loops 261*a* are not restricted to a circular form but can have a variety of forms including a tetragon. For example, the first loops 261*a* can have the same shape as the cross section of the discharge cells 230. The first discharging portion 261 is buried in the first barrier ribs 214. The first connecting portion 262 of the first discharging portion 261 extends from the first barrier ribs 214 to edges of the first substrate 210. The first terminal 263 is connected to an edge of the first connecting portion 262. The first terminal 263 extends parallel from the edge of the first connecting portion 262. Also, the first auxiliary terminal 264 is parallel to the first terminal 263 in the first barrier ribs 214. The first auxiliary terminal 264 increases a contact area of an electrode to more stably form an electrical connection, and is connected to the first connecting portion 262 via the first auxiliary connecting portion 265. The first discharge electrode 260 can be formed using a variety of processes such as a printing process.

A first groove 267 is interposed between the first terminal 263 and the first auxiliary terminal 264 in an outermost side 214*a* of the first barrier ribs 214. As a result, the bottom surface of the first terminal 263 and a top surface of the first auxiliary terminal 264 are exposed. The first groove 267 can be formed discontinuously between a plurality of the first terminals 263 and the first auxiliary terminals 264. However, the first groove 267 can be also formed continuously between the plurality of the first terminals 263 and the first auxiliary terminals 264 in terms of manufacturing convenience.

The first terminal 263 is electrically connected to the first signal connector 291 that electrically connects the PDP 200 and an operating circuit (not shown) of the PDP 200. More specifically, the first signal connector 291 includes a first insertion terminal 291*a* and a first fixing portion 291*b*. The first insertion terminal 291*a* is inserted into the first groove 267, such that the top and the bottom of the first insertion terminal 291*a* are respectively electrically connected to the first terminal 263 and the first auxiliary terminal 264. The first fixing portion 291*b* contacts a bottom surface near the outermost side 214*a* of the first barrier ribs 214. Therefore, the first signal connector 291 and the first barrier ribs 214 are forcibly fixed via the first insertion terminal 291*a* and the first fixing portion 291*b*, thereby increasing the connection between the first discharge electrode 260 and the first signal connector 291 and preventing the first terminal 263 from disconnecting due to an external force.

The first signal connector 291 can be a Flexible Printed Cable (FPC), a Tape Carrier Package (TCP), or a Chip on Film (COF).

The first terminal 263 is connected to each of the conductive portions of the first signal connector 291 via a first anisotropic conductive film 292.

Figure 4:
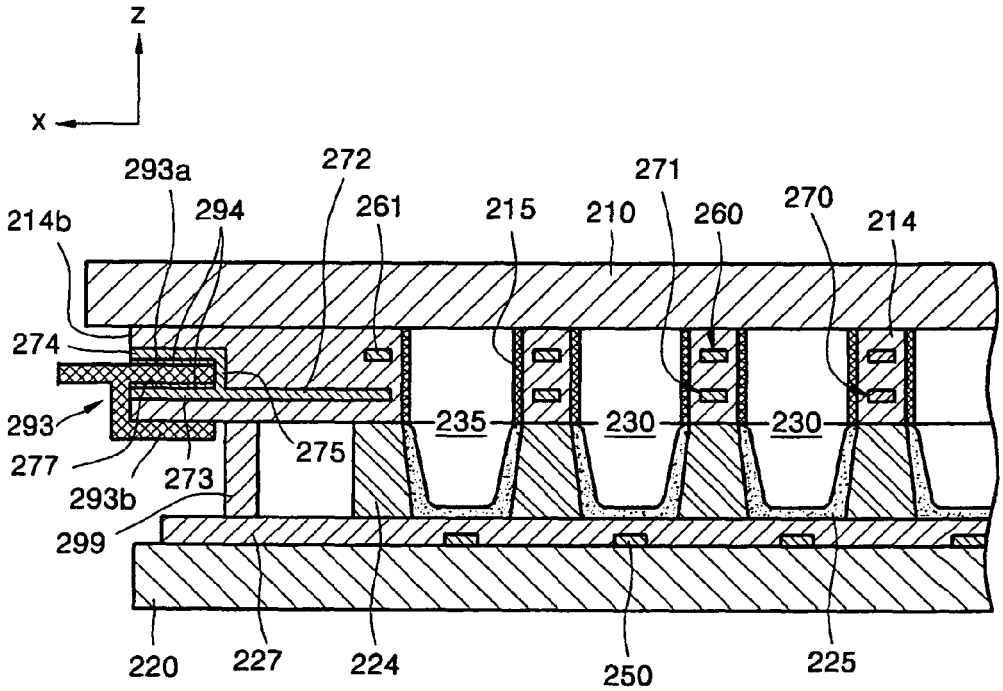
FIG. 4 is a cross-sectional view of the PDP taken along a line IV-IV in FIG. 2.
Figure 5:
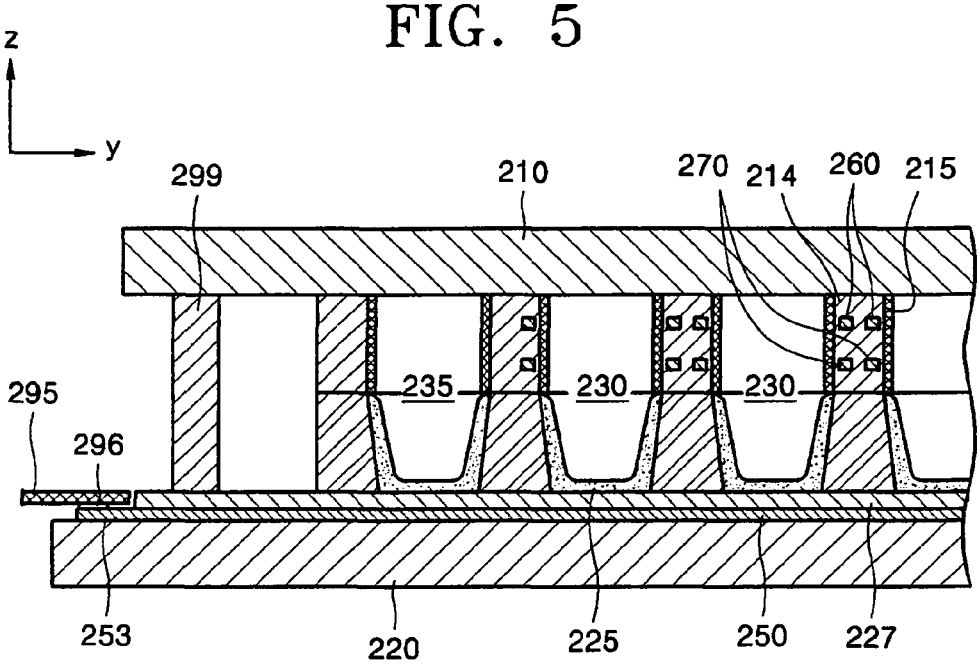
FIG. 5 is a cross-sectional view of the PDP taken along a line V-V in FIG. 2.

Referring to FIG. 4, the second discharge electrodes 270 extend parallel to the first discharge electrodes 260 and are spaced apart from the first discharge electrodes 260 and the first substrate 210 in a perpendicular direction (z direction). The first discharge electrodes 260 are adjacent to the first substrate 210 rather than the second discharge electrodes 270 but are not necessarily restricted thereto.

The second discharge electrode 270 includes a second discharging portion 271, a second connecting portion 272, a second auxiliary connecting portion 275, a second terminal 273, and a second auxiliary terminal 274. The second discharging portion 271 is formed by connecting a plurality of circular second loops 271*a* in which each of the plurality of second loops 271*a* surrounds the discharge cells 230 arranged in a row. The second discharging portion 271 is buried in the first barrier ribs 214. The second connecting portion 272 of the second discharge electrode 270 extends from the first barrier ribs 214 to edges of the first substrate 210. The second terminal 273 is connected to the second connecting portion 272. The second terminal 273 extends parallel from the edge of the second connecting portion 272. Also, the second auxiliary terminal 274 is parallel to the second terminal 273 in the first barrier ribs 214. The second auxiliary terminal 274 increases a contact area of an electrode to more stably form an electrical connection, and is connected to the second connecting portion 272 via the second auxiliary connecting portion 275.

A second groove 277 is interposed between the second terminal 273 and the second auxiliary terminal 274 in an outermost side 214*b* of the first barrier ribs 214. As a result, the top of the second terminal 273 and the bottom of the second auxiliary terminal 274 are exposed through the second groove 277. The second groove 277 can be formed discontinuously between a plurality of the second terminals 273 and the second auxiliary terminals 274. However, the second groove 277 can also be formed continuously between the plurality of the second terminals 273 and the second auxiliary terminals 274 in terms of manufacturing convenience.

The second terminal 273 electrically connects the PDP 200 and an operating circuit (not shown) of the PDP 200 and is electrically connected to the second signal connector 292 including a second insertion terminal 293*a* and a second fixing portion 293*b*. The second insertion terminal 293*a* is inserted into the second groove 277, such that the bottom and the top of the second insertion terminal 293*a* are electrically connected to the second terminal 273 and the second auxiliary terminal 274, respectively. The second fixing portion 293*b* contacts a bottom surface near the outermost side 214*b* of the first barrier ribs 214. Therefore, the second signal connector 293 and the first barrier ribs 214 are forcibly fixed via the second insertion terminal 293*a* and the second fixing portion 293*b*, thereby increasing the connection between the second discharge electrode 270 and the second signal connector 293 and preventing the second terminal 273 from disconnecting due to an external force.

The first and second discharge electrodes 260 and 270 can be formed of a conductive metal, such as aluminum or copper, etc., since they do not reduce the transmission rate of visible light. Therefore, the first and second discharge electrodes 260 and 270 have a small voltage drop, thereby stably transmitting signals.

Figure 6:
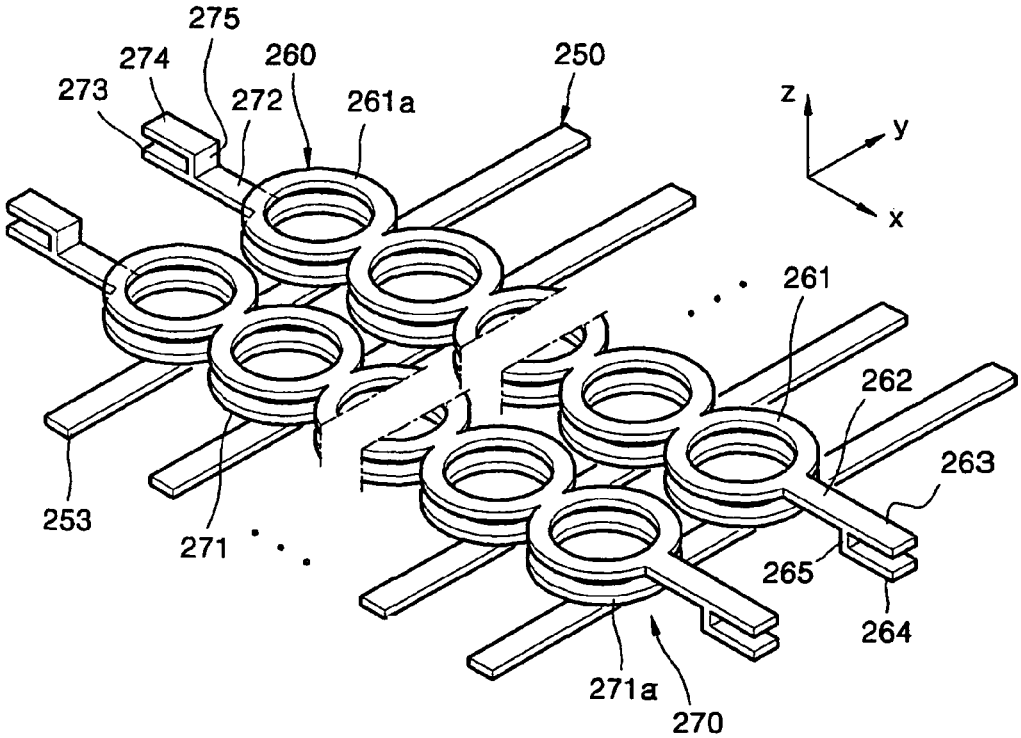
FIG. 6 is a cross-sectional view of discharge cells, first and second discharge electrodes, and address electrodes of FIG. 2.

Referring to FIGS. 2 and 6, the address electrodes 250 cross the first and second discharge electrodes 260 and 270. Also, the address electrodes 250 have a stripe form and are spaced apart from each other. A third terminal 253 is externally exposed and is formed on an edge of each of the address electrodes 250. A plurality of the third terminals 253 can be preferably formed on boundaries of the second substrate 220. The third terminals 253 are electrically connected to the third signal connector 295 via a third anisotropic conductive film 296. The address electrodes 250 can be formed using a variety of processes, such as photo-etching.

In the address electrodes 250 having the above structure, the third terminals 253 are stably supported by the second substrate 220 and are electrically connected to the third signal connector 295, thereby preventing the third terminals 253 from being damaged.

The address electrodes 250 generate an address discharge to assist the first and second discharge electrodes 260 and 270 in generating a sustain discharge, and reduce the voltage needed for effecting the sustain discharge. An address discharge is generated between a scan electrode and an address electrode. When the address discharge is completely effected, positive ions are accumulated in the scan electrode and electrons are accumulated in a common electrode, such that the sustain discharge is easily effected between the scan electrode and the common electrode. In the current embodiment of the present invention, the second discharge electrode 270 adjacent to the address electrode 250 serves as the scan electrode, and the first discharge electrode 260 serves as the common electrode, but are not necessarily restricted thereto.

The dielectric layer 227 is coated on the second substrate 220 to cover the address electrode 250. The dielectric layer 227 can be formed of a dielectric that accumulates wall charges by inducing charges, while preventing the address electrodes 250 from being damaged.

The protective layers 215 are formed on sides of the first barrier ribs 214. The protective layers 215 prevent the first barrier ribs 214 formed of the dielectric and the first and second discharge electrodes 260 and 270 from being damaged due to sputtering of plasma particles, discharge secondary electrons, and reduce a discharge voltage. The protective layers 215 are formed by coating magnesium oxide (MgO), for example, on the sides of the first barrier ribs 214.

The phosphor layers 225 are formed on the second substrate 220 and on sides of the second barrier ribs 224, although they are not necessarily restricted thereto. For example, grooves having a predetermined depth can be formed in the first substrate 210 and the phosphor layers 225 can be arranged in the grooves.

The phosphor layers 225 generate visible light in response to ultraviolet rays. That is, a phosphor layer formed in a red luminous discharge cell can include $Y(V,P)O_4$:Eu, a phosphor layer formed in a green luminous discharge cell can include $Zn_2SiO_4$:Mn, or $YBO_3$:Tb, and a phosphor layer formed in a blue luminous discharge cell can include BAM:Eu.

The sealing member 299 that surrounds the discharge cells 230 and the dummy cells 235 is interposed between the first substrate 210 and the second substrate 220 and seals an inner space from outside. The sealing member 299 is interposed between the first barrier ribs 214 and the dielectric layer 227 such that both sides of the first barrier ribs 214 can be externally extended.

A discharge gas, such as Ne, Xe, and a mixture thereof, is sealed in the discharge cells 230. In the present invention, a discharge surface is increased and a discharge area is expanded, which increases an amount of plasma and allows operation at a low voltage. Therefore, the PDP 200 can be operated at a low voltage when a high density Xe gas is used as the discharge gas, thereby dramatically increasing luminous efficiency, in contrast to the conventional PDP 100 that cannot be operated at a low voltage when a high density Xe gas is used as the discharge gas.

The PDP 200 according to the current embodiment of the present invention generates an address discharge by supplying an address voltage to an address electrode 250 and a second discharge electrode 270, resulting in the selection of a discharge cell 230 that generates a sustain discharge.

Thereafter, when a sustain voltage is supplied between the first discharge electrode 260 and the second discharge electrode 270 of the selected discharge cell 230, the sustain discharge is generated between the first and second discharge electrodes 260 and 270. An energy level of the discharge gas excited by the sustain discharge is reduced, thereby discharging ultraviolet rays. The ultraviolet rays excite the phosphor layers 225 coated in the discharge cells 230, such that an energy level of the excited phosphor layers 225 is reduced to discharge visible light. The discharged visible light forms an image.

The conventional PDP 100 has a small discharge area since the sustain discharge is generated perpendicularly between the sustain electrodes 106 and 107. However, the PDP 200 according to the current embodiment of the present invention generates the sustain discharge on all sides of the discharge cells 230 that define the discharge cells 230 and a large discharge area as well.

In the current embodiment of the present invention, the sustain discharge is formed as a closed curve along the sides of the discharge cell 230 and is gradually extended to the center of the discharge cell 230. Accordingly, the area where the sustain discharge is generated increases and space charges of a discharge cell that is rarely used contributes to luminous, resulting in the increase of luminous efficiency of the PDP 200. In particular, in the current embodiment of the present invention, the discharge cells 230 having circular cross-sections generate a constant sustain discharge on all sides.

Also, the sustain discharge is generated in the center of the discharge cells 230, which prevents ion-sputtering from damaging the phosphor layer 225 due to charged particles and prevents causing a permanent afterimage even if an image is displayed for a long time.

A PDP 300 according to another embodiment of the present invention is described below with reference to FIGS. 7 through 10 in terms of differences between the current embodiment and the previous embodiment.

The PDP 300 includes a first substrate 310, a second substrate 320, first discharge electrodes 360, second discharge electrodes 370, address electrodes 350, first barrier ribs 314, second barrier ribs 324, protective layers 315, phosphor layers 325, a dielectric layer 327, a sealing member 399, first, second, and third signal connectors 391, 393, and 395, and a discharge gas (not shown).

The first substrate 310 and the second substrate 320 face each other and are spaced apart from each other. The first barrier ribs 314 that partition a plurality of discharge cells 330 and dummy cells 335 are interposed between the first substrate 310 and the second substrate 320. The second barrier ribs 324 are interposed between the first barrier ribs 314 and the second substrate 320. The second barrier ribs 324 partition the discharge cells 330 together with the first barrier ribs 314.

Figure 7:
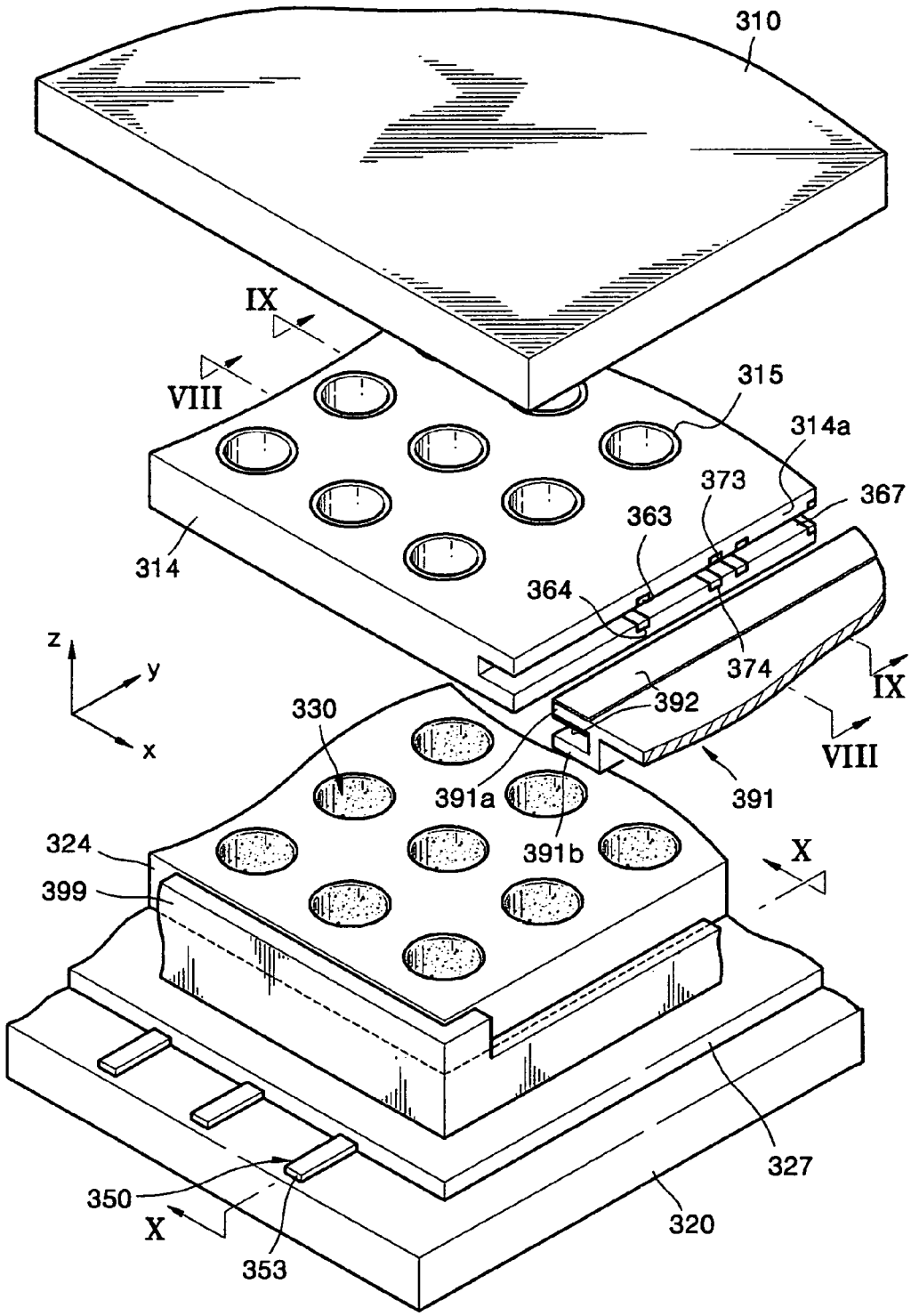
FIG. 7 is a partially exploded perspective view of a PDP according to another embodiment of the present invention.
Figure 8:
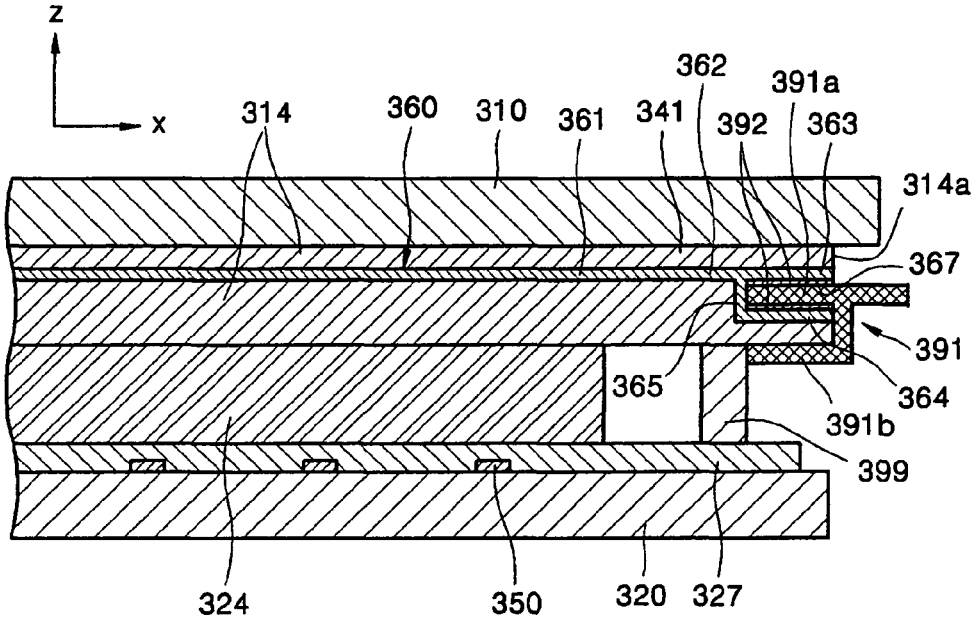
FIG. 8 is a cross-sectional view of the PDP taken along a line VIII-VIII in FIG. 7.

Referring to FIGS. 7 and 8, the first discharge electrodes 360 that are paired with the second discharge electrodes 370 generate a discharge from the discharge cells 330. The first discharge electrodes 360 and the second discharge electrodes 370 face each other and extend parallel to each other. Each of the first discharge electrodes 360 extend in a direction to have a stripe form, and includes a first discharging portion 361, a first connecting portion 362, a first auxiliary connecting portion 365, a first terminal 363, and a first auxiliary terminal 364. The first discharging portion 361 generates a discharge in the discharge cells 330 and is buried in the first barrier ribs 214. The first connecting portion 362 of the first discharging portion 361 extends from the first barrier ribs 314 to edges of the first substrate 310. The first terminal 363 is connected to an edge of the first connecting portion 362. The first terminal 363 extends parallel from the edge of the first connecting portion 362. Also, the first auxiliary terminal 364 is parallel to the first terminal 363 in the first barrier ribs 314, and is connected to the first connecting portion 362 via the first auxiliary connecting portion 365.

A first groove 367 is interposed between the first terminal 363 and the first auxiliary terminal 364 in an outermost side 314*a* of the first barrier ribs 314. As a result, a bottom surface of the first terminal 363 and a top surface of the first auxiliary terminal 364 are exposed through the first groove 367.

The first terminal 363 electrically connects the first discharge electrode 360 and an operating circuit (not shown) of the PDP 300 and is electrically connected to the first signal connector 391 that includes a first insertion terminal 391*a* and a first fixing portion 391*b*. The first insertion terminal 391*a* is inserted into the first groove 367, such that the top surface and the bottom surface of the first insertion terminal 391*a* are electrically connected to the first terminal 363 and the first auxiliary terminal 364, respectively. The first fixing portion 391*b* contacts a bottom surface near the outermost side 314*a* of the first barrier ribs 314. Therefore, the first signal connector 391 and the first barrier ribs 314 are forcibly fixed via the first insertion terminal 391*a* and the first fixing portion 391*b*, thereby increasing the connection between the first discharge electrode 360 and the first signal connector 391 and preventing the first terminal 363 from disconnecting due to an external force.

Figure 9:
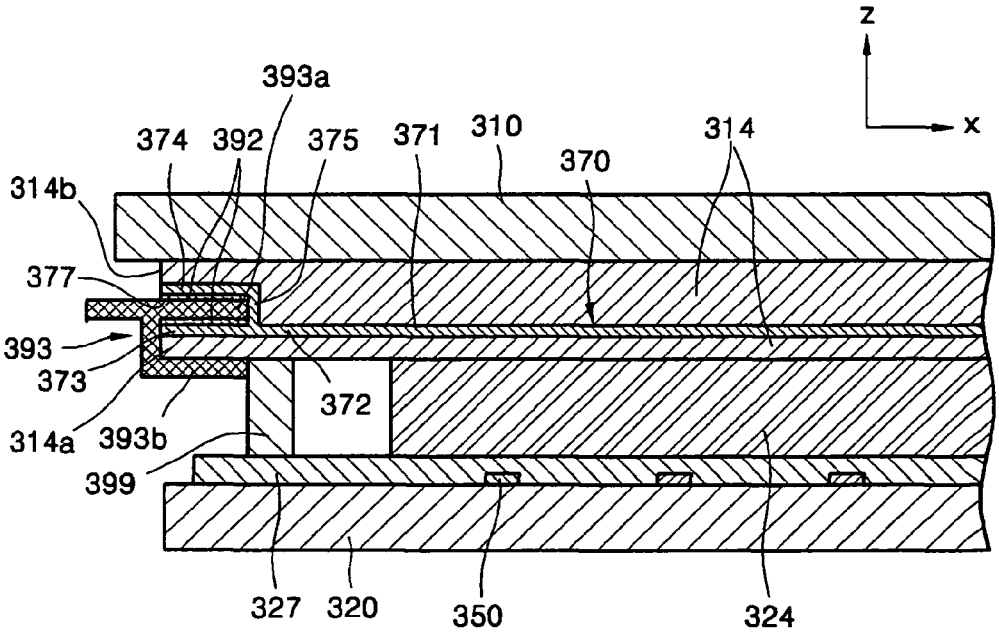
FIG. 9 is a cross-sectional view of the PDP taken along a line IX-IX in FIG. 7.

Referring to FIGS. 7 and 9, the second discharge electrodes 370 extend parallel to the first discharge electrodes 360 and have a stripe form. Each of the second discharge electrodes 370 includes a second discharging portion 371, a second connecting portion 372, a second auxiliary connecting portion 375, a second terminal 373, and a second auxiliary terminal 374. The second discharging portion 371 is buried in the first barrier ribs 314. The second connecting portion 372 of the second discharge electrodes 370 extends from the first barrier ribs 314 to edges of the first substrate 310. The second terminal 373 is connected to an edge of the second connecting portion 372. The second terminal 373 extends parallel from the edge of the second connecting portion 372. Also, the second auxiliary terminal 374 is parallel to the second terminal 373 in the first barrier ribs 314. The second auxiliary terminal 374 increases a contact area of an electrode to more stably form an electric connection, and is connected to the second connecting portion 372 via the second auxiliary connecting portion 375.

A second groove 377 is interposed between the second terminal 373 and the second auxiliary terminal 374 in an outermost side 314*b* of the first barrier ribs 314. As a result, a top surface of the second terminal 373 and a bottom surface of the second auxiliary terminal 374 are exposed through the second groove 377. The second groove 377 can be formed discontinuously between a plurality of the second terminals 373 and the second auxiliary terminals 374. However, the second groove 377 can be also formed continuously between the plurality of the second terminals 373 and the second auxiliary terminals 374 in terms of manufacturing convenience.

The second terminal 373 is electrically connected to the second signal connector 393 including a second insertion terminal 393*a* and a second fixing portion 393*b*. The second insertion terminal 393*a* is inserted into the second groove 377, such that a bottom surface and a top surface of the second insertion terminal 393*a* are electrically connected to the second terminal 373 and the second auxiliary terminal 374, respectively. The second fixing portion 393*b* contacts a bottom surface near the outermost side 314*b* of the first barrier ribs 314. Therefore, the second signal connector 393 and the first barrier ribs 314 are forcibly fixed via the second insertion terminal 393*a* and the second fixing portion 393*b*, thereby increasing the connection between the second discharge electrode 370 and the second signal connector 393 and preventing the second terminal 373 from disconnecting due to an external force.

Figure 10:
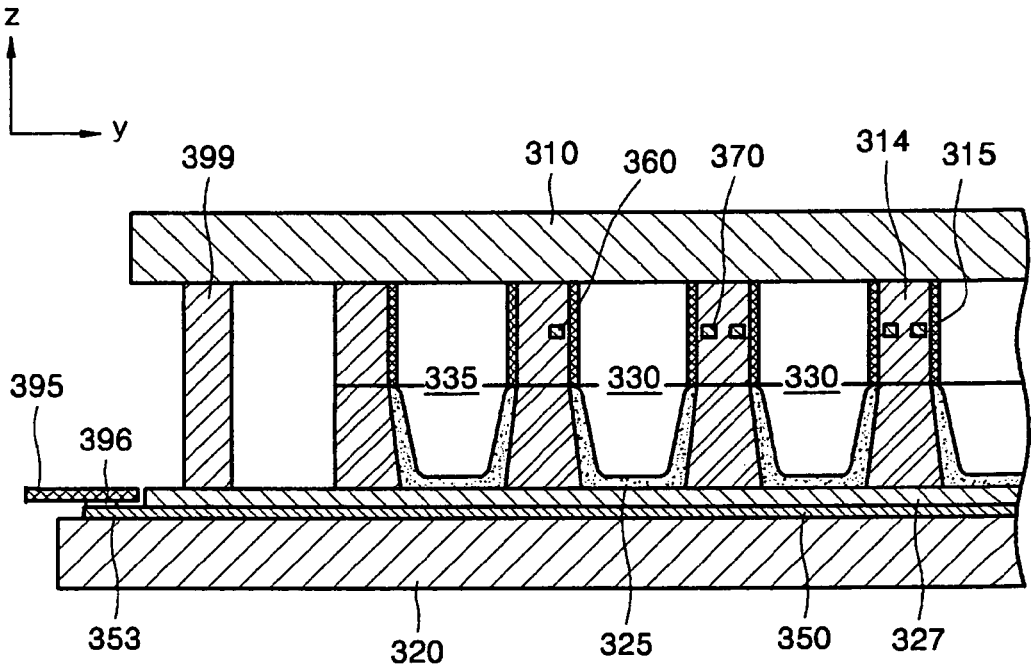
FIG. 10 is a cross-sectional view of the PDP taken along a line X-X in FIG. 7.

Referring to FIGS. 7 and 10, the address electrodes 350 cross the first and second discharge electrodes 360 and 370. Also, the address electrodes 350 have a stripe form and are spaced apart from each other on the second substrate 320. A third terminal 353 is externally exposed and is formed on an edge of each of the address electrodes 350. The third terminals 353 can be preferably formed on edges of the second substrate 320. The third terminals 353 are electrically connected to the third signal connector 395 via a third anisotropic conductive film 396. In the address electrodes 350 having the above structure, the third terminals 353 are stably supported by the second substrate 320 and are electrically connected to the third signal connector 395, thereby preventing the third terminals 353 from being damaged.

The dielectric layer 327 is coated on the second substrate 320 to cover the address electrodes 350. The protective layers 315 are formed on sides of the first barrier ribs 314.

The phosphor layers 325 are formed on the second substrate 320 on the sides of the second barrier ribs 324. The sealing member 399 that surrounds the discharge cells 330 and the dummy cells 335 is interposed between the first substrate 310 and the second substrate 320 and seals an inner space from outside. A discharge gas, such as Ne, Xe, or a mixture thereof, is sealed in the discharge cells 330.

The PDP 300 according to another embodiment of the present invention generates an address discharge by supplying an address voltage to an address electrode 350 and a second discharge electrode 370, resulting in the selection of a discharge cell 330 that generates a sustain discharge. Thereafter, when a sustain voltage is supplied between the first discharge electrode 360 and the second discharge electrode 370 of the selected discharge cell 330, the sustain discharge is generated between the first and second discharge electrodes 360 and 370. An energy level of the discharge gas excited by the sustain discharge is reduced, thereby discharging ultraviolet rays. The ultraviolet rays excite the phosphor layers 325 coated in the discharge cells 330, such that an energy level of the excited phosphor layers 325 is reduced to discharge visible light. The discharged visible light forms an image.

The PDP according to the present invention has the following effects:

The terminals of the discharge electrodes are stably connected to the signal connector, thereby reducing a failure rate in transferring signals due to an open circuit. Also, the terminals are arranged in the first barrier ribs, thereby preventing the terminals from being damaged.

Therefore, the PDP according to the present invention can reduce damage to a terminal of a discharge electrode.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP), comprising:

first and second substrates spaced apart from each other and facing each other;

first barrier ribs interposed between the first and second substrates and partitioning a plurality of discharge cells; and a plurality of pairs of discharge electrodes adapted to generate a discharge in the discharge cells;

wherein the discharge electrodes are buried in the first barrier ribs, extend along an outside of the discharge cells arranged in a direction to form a terminal in an edge of the discharge electrodes, and wherein at least one groove is arranged in an outermost side of the first barrier ribs through which the terminals of the discharge electrodes are exposed, wherein the discharge electrodes further comprise auxiliary terminals electrically connected to the terminals, wherein the terminals and the auxiliary terminals are spaced apart from each other on either the first substrate or the second substrate in a perpendicular direction, and wherein the at least one groove is arranged between the terminals and the auxiliary terminals.

2. The PDP of claim 1, wherein the at least one groove is exposed to either a bottom or top surface of the terminals of the discharge electrodes.

3. The PDP of claim 1, further comprising a signal connector interposed between the terminal and the auxiliary terminal and adapted to be connected to both the terminal and the auxiliary terminal and to transfer an electrical signal to the discharge electrode.

4. The PDP of claim 3, wherein the signal connector comprises an insertion terminal adapted to be inserted between the terminal and the auxiliary terminal, and a fixing portion including a first end connected to the insertion terminal and a second end contacting either the top or the bottom of the first barrier ribs to increase a connection between the insertion terminal and the discharge electrode.

5. The PDP of claim 1, wherein the first barrier ribs comprise a dielectric material.

6. The PDP of claim 1, wherein each of the pairs of discharge electrodes comprises a first discharge electrode and a second discharge electrode that extend in parallel each other.

7. The PDP of claim 6, wherein the first and second discharge electrodes at least partially surround the discharge cells and are arranged in a direction.

8. The PDP of claim 6, wherein the first and second discharge electrodes face each other.

9. The PDP of claim 6, further comprising address electrodes extending to cross the first and second discharge electrodes.

10. The PDP of claim 9, wherein terminals of the address electrodes are arranged on the first substrate or the second substrate.

11. The PDP of claim 10, further comprising a dielectric layer covering the address electrodes.

12. The PDP of claim 11, further comprising second barrier ribs interposed between the dielectric layer and the first barrier ribs and adapted to partition the discharge cells together with the first barrier ribs.

13. The PDP of claim 12, further comprising phosphor layers arranged on sides of the second barrier ribs.

14. The PDP of claim 1, further comprising protective layers arranged on sides of the first barrier ribs.

* * * * *